US010343201B2

(12) United States Patent
Rossbach

(10) Patent No.: US 10,343,201 B2
(45) Date of Patent: Jul. 9, 2019

(54) INSTALLATION AND METHOD FOR CONTINUOUSLY SHAPING LONGITUDINALLY SLOTTED PIPES

(71) Applicant: SMS group GmbH, Duesseldorf (DE)

(72) Inventor: Axel Rossbach, Korschenbroich (DE)

(73) Assignee: SMS group GmbH, Duesseldorf (DE)

( * ) Notice: Subject to any disclaimer, the term of this patent is extended or adjusted under 35 U.S.C. 154(b) by 268 days.

(21) Appl. No.: 14/349,713

(22) PCT Filed: Oct. 5, 2012

(86) PCT No.: PCT/DE2012/000970
§ 371 (c)(1),
(2) Date: Apr. 4, 2014

(87) PCT Pub. No.: WO2013/050021
PCT Pub. Date: Apr. 11, 2013

(65) Prior Publication Data

US 2014/0238095 A1 Aug. 28, 2014

(30) Foreign Application Priority Data

Oct. 5, 2011 (DE) ..... 10 2011 114 847
Oct. 28, 2011 (DE) ..... 10 2011 117 166

(51) Int. Cl.
*B21D 5/08* (2006.01)
*B21D 5/12* (2006.01)
(Continued)

(52) U.S. Cl.
CPC ..... *B21B 17/14* (2013.01); *B21C 37/083* (2013.01); *B21D 5/12* (2013.01); *B21C 37/0822* (2013.01);
(Continued)

(58) Field of Classification Search
CPC . B21C 37/105; B21C 37/083; B21C 37/0822; B21C 37/101; B21D 5/10;
(Continued)

(56) References Cited

U.S. PATENT DOCUMENTS 3,170,427 A * 2/1965 Ruple ..... B21C 37/0822 228/49.1
4,122,696 A * 10/1978 Midzutani ..... B21D 5/12 72/178
(Continued)

FOREIGN PATENT DOCUMENTS

CN 101961826 A 2/2011
CN 102176987 A 6/2013
(Continued)

OTHER PUBLICATIONS

Canadian Office Action dated Sep. 11, 2015 in Canadian Application No. 2,851,150.
(Continued)

*Primary Examiner* — Gregory D Swiatocha
(74) *Attorney, Agent, or Firm* — Collard & Roe, P.C.

(57) ABSTRACT

A method and an installation for continuously shaping longitudinally slotted pipes from a flat material minimizes or avoids markings in the material by evenly introducing into the roll stand the rolling forces of at least two rolls acting successively on the flat material and/or by allowing the two successively acting rolls to align freely relative to one another.

20 Claims, 6 Drawing Sheets

Figure 1:
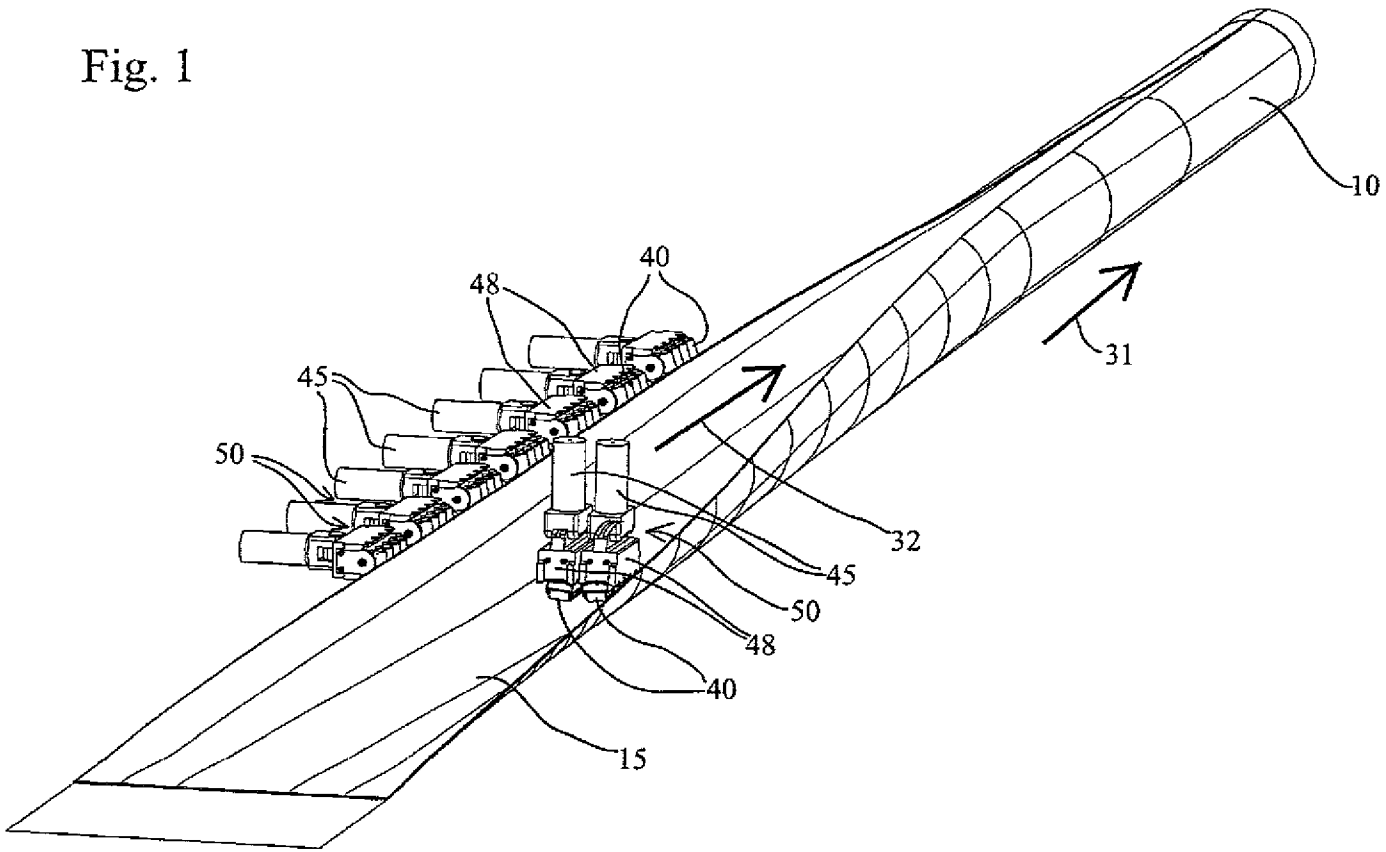

(51) Int. Cl.

| | |
|---|---|
| ***B21D 5/14*** | (2006.01) |
| ***B21B 17/14*** | (2006.01) |
| ***B21C 37/08*** | (2006.01) |
| ***B21C 37/10*** | (2006.01) |
| ***B21C 37/083*** | (2006.01) |

(52) U.S. Cl.
CPC ..... *B21C 37/105* (2013.01); *B21D 5/08* (2013.01); *B21D 5/086* (2013.01); *B21D 5/14* (2013.01)

(58) Field of Classification Search
CPC ... B21D 5/12; B21D 5/06; B21D 5/08; B21D 5/086; B21D 5/14; B21B 17/14
USPC ..... 72/51, 52
See application file for complete search history.

(56) References Cited

U.S. PATENT DOCUMENTS 4,299,108 A * 11/1981 Kato ..... B21D 5/10 228/147
4,675,489 A * 6/1987 Opprecht ..... B23K 37/053 219/121.63
4,697,446 A * 10/1987 Yamamoto ..... B21D 5/10 72/178
4,947,013 A * 8/1990 Rolli ..... B21D 51/2646 219/64
4,947,671 A 8/1990 Lindstroem
5,301,869 A * 4/1994 Toyooka ..... B21C 37/08 228/147
5,706,691 A * 1/1998 Okamoto ..... B21D 5/12 72/20.1
5,784,911 A * 7/1998 Hashimoto ..... B21D 5/086 72/176
5,865,053 A * 2/1999 Abbey, III ..... B21D 5/12 72/176
5,878,614 A * 3/1999 Okamoto ..... B21C 37/08 72/178
6,351,978 B1 * 3/2002 Kusakabe ..... B21D 5/12 72/52
8,100,312 B2 1/2012 Travini et al.
8,893,539 B2 11/2014 Valle

FOREIGN PATENT DOCUMENTS

| | | | |
|---|---|---|---|
| DE | 31 50 382 | C2 | 7/1983 |
| DE | 41 15 109 | A1 | 11/1992 |
| EP | 0 185 299 | A1 | 6/1986 |
| EP | 0 250 594 | B2 | 11/1997 |
| EP | 0 976 468 | B1 | 2/2000 |
| JP | H 2-55616 | A | 2/1990 |
| JP | 2000-15348 | A | 1/2000 |

OTHER PUBLICATIONS

Russian Office Action dated Dec. 23, 2015 in Russian Application No. 2014112947/02(020253).
English translation of Japanese Office Action dated Jul. 28, 2015 in Japanese Application No. 2014-533767.
English translation of relevant parts of Chinese Office Action dated Feb. 10, 2015 in Chinese Application No. 201280049458.5.
International Search Report of PCT/DE2012/000970, dated May 29, 2013.

* cited by examiner

Fig. 8
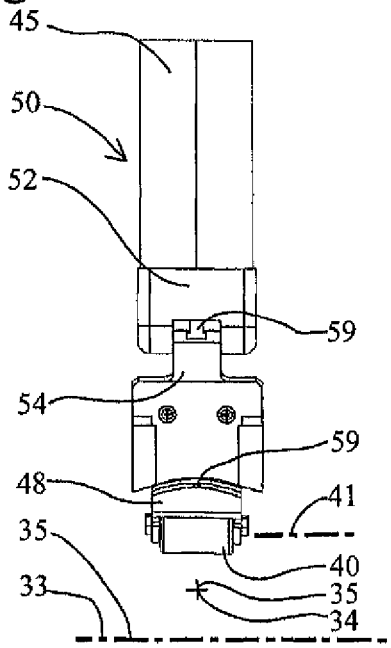
Fig. 10
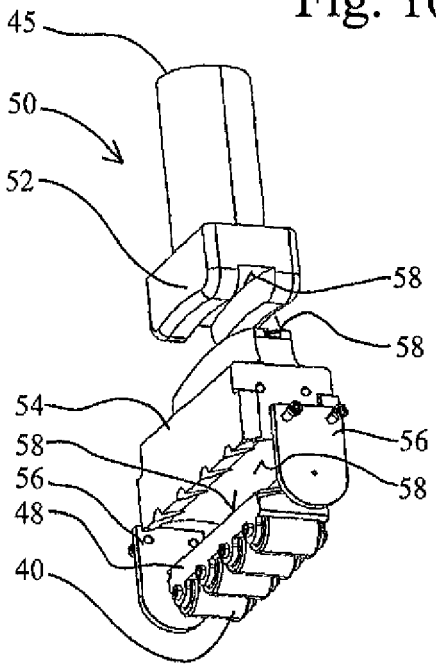
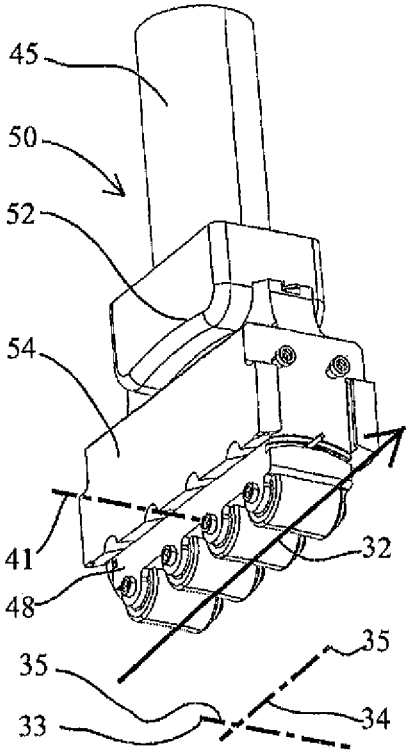
Fig. 9
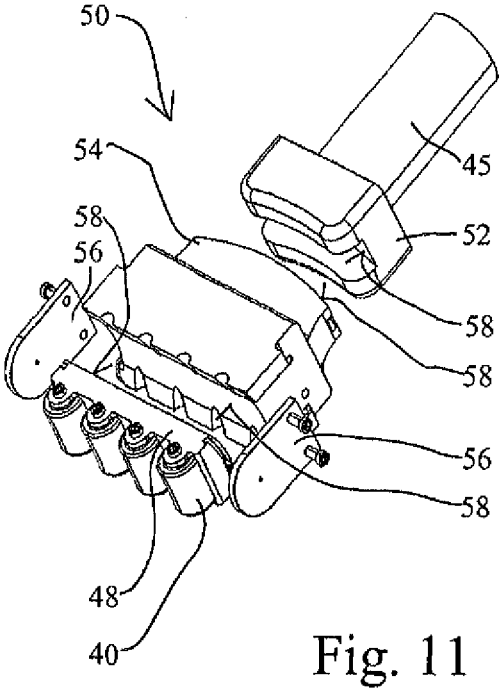
Fig. 11

INSTALLATION AND METHOD FOR CONTINUOUSLY SHAPING LONGITUDINALLY SLOTTED PIPES

CROSS REFERENCE TO RELATED APPLICATIONS

This application is the National Stage of PCT/DE2012/000970 filed on Oct. 5, 2012, which claims priority under 35 U.S.C. § 119 of German Application Nos. 10 2011 114 847.0 filed on Oct. 5, 2011, and 10 2011 117 166.9 filed on Oct. 28, 2011, the disclosures of which are incorporated by reference. The international application under PCT article 21(2) was not published in English.

The invention relates to a system for continuous molding of longitudinally slotted pipes from a flat material, having roll stands disposed one behind the other in the system direction, which stands each carry at least one roll, and to a method for continuous molding of longitudinally slotted pipes from a flat material, wherein the flat material is successively moved past multiple roll arrangements and bent accordingly.

A system and a method for continuous molding of longitudinally slotted pipes from a flat material is known from DE 31 50 382 C2, for example, whereby for this purpose, the flat material is pre-bent in U shape in a first roll stand, and then finish-formed by way of finishing rolls disposed in a subsequent roll stand. Likewise, EP 0 976 468 B1 and EP 0 250 594 B2 show such arrangements, whereby in the case of the latter, however, only one roll per roll stand are is disposed one behind the other, which rolls can be positioned along a contour, within certain limits, in each instance, and the arrangement of the rolls, in each instance, varies from one roll stand to another. The first arrangement shows roll stands having two rolls disposed one behind the other in the system direction, which rolls are freely mounted on a roll support, so that they can follow a material movement within certain limits.

It is the task of the present invention to avoid possible markings on the product as much as possible.

As a solution, systems having the characteristics of described herein and methods having the characteristics described herein are proposed. Further advantageous embodiments are also found in the following description. In this connection, the invention is based on the fundamental recognition that the task can be pursued, in targeted manner, by means of stabilization of the rolls as such.

As a solution, a system for continuous molding of longitudinally slotted pipes from a flat material, having roll stands disposed one behind the other in the system direction, which stands each carry at least one roll, is proposed, wherein the system is characterized in that at least one of the roll stands has a roll support that carries at least three rolls disposed one behind the other in the system direction, and is mounted freely on the roll stand that carries the roll support, by way of roll positioning means having a degree of rotational freedom parallel to at least one roll axis of a roll carried by the roll support and/or perpendicular to the material running direction of at least one roll carried by the roll support. This makes it possible to distribute the local press-down pressure of the rolls carried by the roll support or of the rolls successively acting on the flat material as uniformly as possible to the flat material, and, in particular, to significantly reduce instabilities. In particular, force peaks caused by vibration and similar instabilities and, accordingly, possible markings on the product can be avoided, as compared with the system according to EP 0 976 468 B1. In this connection, it has been shown that possible corrugations or other irregularities of the material to be molded, which can be found in the material to be molded, are not reinforced by means of three or more rolls that are disposed on a freely positioning roll support or by means of three or more freely positioning rolls, because two of the rolls stabilize one another and the third roll, if the third roll arrives at such a corrugation or at such an irregularity.

In particular, it is advantageous if the roll support is freely mounted on the roll stand with regard to the aforementioned degree of rotational freedom. Accordingly, it is advantageous if the three rolls that act on the flat material successively can freely position themselves relative to one another. In this manner, the rolling force can be distributed as uniformly as possible to the two rolls, so that the force applied to the flat material by one of the two rolls can be minimized, thereby accordingly minimizing the risk of markings.

Free positioning or free mounting can take place, for example, by means of a rocker-like mounting of the roll support or also by means of hydraulic mounting in the form of a hydraulic scale.

Accordingly, it is advantageous if the two rolls that act successively are guided jointly, because in this way they can be positioned freely relative to one another, in relatively simple manner.

In this connection, it should be emphasized that the term "roll stand" should be understood to mean arrangements that absorb the rolling forces and counteract them, in such a manner that the roll positions are maintained to a predetermined degree during rolling. In this connection, the rolling forces can be introduced into the building that surrounds the system, on the one hand, or preferably can be neutralized by way of correspondingly ring-shaped roll stands or roll stands closed in some other manner.

The possibility of free positioning of the roll supports brings about the result, in the solution mentioned above, that the axes of the two rolls are rigidly connected with one another, on the one hand, but on the other hand force differences balance out by way of the free positioning ability, so that the rolling forces of these two rolls are averaged out and therefore introduced into the roll stand in torque-free manner.

Accordingly, a method for continuous molding of longitudinally slotted pipes from a flat material, wherein the flat material is successively moved past multiple roll arrangements and bent accordingly, is also proposed, wherein the method is characterized in that the rolling forces of at least three rolls that act on the flat material successively are introduced into the roll stand in averaged manner, and/or three successively acting rolls freely position themselves, relative to one another.

In deviation from the state of the art, in which the work must be done with relatively large roll diameters, in order not to allow the rolling forces to act on the flat material in point-like manner, and thereby to avoid markings on the product, smaller rolls can be disposed closely one behind the other by means of the arrangement of three or more rolls on a roll support or by means of averaged rolling forces introduced into the roll stand, so that ultimately, these rolls put less stress on the flat materials, in terms of their local stress, than would be possible in the case of large rolls, in which the existing cross-sectional surface is naturally filled up quickly, purely in terms of space. In particular, it is also possible to reduce the risk of vibration and similar instabilities. The overdetermination that appears to exist, at first, contributes so significantly to an increase in smoothness that markings can be very effectively prevented in this way.

Preferably, the two rolls that successively act on the flat material are articulated jointly, so that they essentially behave like one roll.

Furthermore, it should be explained in this connection that here, the term "system direction" refers to the average pass-through direction of the material through the system. In this connection, the system direction stands perpendicular to the transverse direction, which is essentially defined by cross-sections of the flat material that pass through the system at the same time. Accordingly, the expression "one behind the other in the system direction" refers to an arrangement through which a cross-section of the flat material passes successively.

Such a system also has a material running direction, not averaged but rather locally, in each instance, that is locally defined by means of the movement of a point of the flat material, in each instance. Aside from natural oscillations or uneven running that occur(s) in such rolling processes, the material running direction remains constant at a point of the system, once the system has been broken in.

Preferably, the three rolls carried by the roll support are disposed one behind the other in the material running direction, so that at least one material point of the flat material that touches a first roll of the two rolls disposed one behind the other in the system direction also touches the second roll of the two rolls disposed one behind the other in the system direction. This touching, however, does not necessarily have to happen at the same axial height of the two rolls, so that the support can stand at a slight slant with reference to the material running direction. In this manner, the rolling force that is applied by way of the common roll support can be distributed in the flat material even further.

In this connection, it has turned out that a roll support should not carry more than ten rolls disposed one behind the other in the system direction or that the rolling forces of not more than ten rolls successively acting on the flat material should be introduced into the roll stand, in averaged manner, and/or that not more than ten successively acting rolls should position themselves freely relative to one another, because otherwise, the advantages of free roll positioning or of the corresponding averaging no longer come to bear.

The risk of markings can furthermore be reduced in that the roll support is disposed on the roll stand that carries the roll support, by way of roll positioning means, with a degree of rotational freedom perpendicular to a roll axis of a roll carried by it and/or parallel to the material running direction of the roll belonging to this roll axis. In this manner, the rolls disposed on the roll support can be positioned as optimally as possible with regard to the local curvature of the flat material in the transverse direction, in order to thereby also guarantee the most uniform force distribution possible in this manner.

The latter can be implemented, in terms of process technology, particularly in very simple manner, if the roll support, with reference to a degree of rotational freedom, is freely mounted on the roll stand that carries the roll support, perpendicular to a roll axis of a roll carried by the roll support and/or parallel to the material running direction of the roll belonging to this roll axis. By means of this free mounting, the roll support can position itself in such a manner that forces acting on the rolls in cross-section are minimized, thereby ultimately accordingly also bringing about minimization of the local forces and therefore a corresponding reduction in markings. In this connection, it is understood that this embodiment can be utilized, even independent of the use of a roll support, for the purpose of having a roll automatically position itself, with reference to the cross-section of the flat material, in a manner that is as gentle on the material as possible.

Accordingly, a system for continuous molding of longitudinally slotted pipes from a flat material, having roll stands disposed one behind the other in the system direction, which carry at least one roll, in each instance, is advantageous, in which system at least one of the rolls is mounted freely on the roll stand that carries the roll, by way of roll positioning means having a degree of rotational freedom perpendicular to a roll axis and/or parallel to the material running direction of the roll belonging to this roll axis or parallel to the material running direction of a roll carried by the roll support.

Likewise, a method for continuous molding of longitudinally slotted pipes from a flat material is advantageous as a solution, wherein the flat material is successively moved past multiple roll arrangements and bent accordingly, and wherein the method is characterized in that at least one roll freely follows the rolling forces, in each instance, perpendicular to its roll axis and/or parallel to the material running direction of this roll.

In total, the free positioning ability also has the advantage, in the case of a suitable configuration of the overall system, that the system can be positioned or adjusted relatively easily, because angle deviations between work piece and rolls that almost cannot be avoided, as such, because of the relatively complex deformations of the work piece for continuous molding of longitudinally slotted pipes, in the event of a change in the positioning or adjustment, in the case of rigid guidance, are automatically equalized within corresponding limits, as the result of the free positioning ability. This advantage already occurs in the case of free positioning ability merely in one dimension, whereby a combination of the free positioning ability perpendicular and parallel to the roll axis or perpendicular and parallel to the material running direction, as described above, is correspondingly cumulatively advantageous.

The above-mentioned degrees of rotational freedom can be made available by means of suitable guides or rotary or ball joints of the system. In this connection, it is generally easier to implement this, in terms of mechanical engineering, if the two above-mentioned degrees of rotational freedom are represented in a separate guide device or in a separate rotary joint, in each instance. This is done in particularly simple manner, in terms of construction, by means of rotary joints having bearing surfaces in the shape of a circular ring, which can be implemented, for example, by means of a hinge bolt that carries a swivel head of the movable module, introduced into a fork. In contrast, the structural simplicity has the disadvantage—depending on the concrete conditions—that the axis of rotation is also found coaxial to the hinge bolt. Here, greater degrees of freedom are offered by suitable guides, such as linear guides having curved running surfaces, for example. Such arrangements make it possible to implement significantly more complex movement sequences of the modules relative to one another, in each instance, so that the axis of rotation, in particular, can also be selected more freely, and—in the case of more complex movement sequences—can also be selected to be displaceable as a function of the positioning position of the modules that are movable relative to one another.

In this connection, it should be emphasized that from a structural aspect, both roller bearings and slide bearings of any kind can be used as suitable bearings.

Depending on the position of the axis of rotation of the above-mentioned degrees of rotational freedom, the overall arrangement, with regard to the rotary joint or the guide, can be in an unstable equilibrium position, so that the risk exists, particularly in the case of high rolling forces, that the arrangement breaks out at the level of the guide or at the level of the rotary joint, and this can be triggered by means of process-immanent vibrations or the like, for example. In order to minimize this risk, the rolls can be selected to be wider than half their diameter, particularly actually wider than their diameter, on the one hand. The implementation of such wide rolls as such is diametrically opposed to the efforts of the state of the art, of using rolls having the greatest possible diameters in order to avoid or minimize markings, and stands in direct harmony with the solution mentioned initially, of distributing the rolling forces among multiple smaller rolls, disposed one behind the other, if applicable. Such wide rolls furthermore simplify disposing the rolls one behind the other in the material running direction and allowing an offset, in this connection.

As a further measure for counteracting such an unstable situation, the roll positioning means can have an axis of rotation, at least in one positioning position, which is represented on the other side of the flat material in a positioning position of the roll positioning means with regard to the degrees of rotational freedom, from the perspective of the corresponding roll. In this way, the roll stabilizes itself, so that process-immanent uneven running can ultimately be countered by the roll, in stable manner, in each instance.

It is understood that an axis of rotation represented in such a manner, and the diameter/length ratio of the rolls indicated above are advantageous, even independent of the other characteristics of the present invention, for a system or for a method for continuous molding of longitudinally slotted pipes from a flat material, having roll stands disposed one behind the other in the system direction, which stands carry at least one roll, in each instance, or having a flat material that is successively moved past multiple roll arrangements and bent accordingly.

Accordingly, it is also advantageous if the roll follows the rolling forces, in each instance, perpendicular to its roll axis and parallel to the material running direction of this roll, at least in one positioning position, with an axis of rotation represented on the other side of the flat material, from the perspective of the corresponding roll.

In the case of rolls acting on the flat material successively, in particular, the two rolls are preferably guided, in at least one positioning position, with an axis of rotation represented on the other side of the flat material, from the perspective of the two rolls that act successively, in order to implement the advantages explained above.

It is furthermore understood that an axis of rotation represented on the other side of the flat material, from the perspective of the roll, does not necessarily need to be provided in all positioning positions, and not necessarily with regard to both degrees of rotational freedom mentioned above. This is particularly dependent on the other process parameters, such as the rolling forces, the geometries of the rolls, and the expected uneven running.

In order to increase even running, and, in particular, also to increase the stability in freely positioning rolls and roll supports, a spring arrangement that acts in the movement direction or a corresponding suspension of the roll positioning means can be provided, so that the rolls or the roll supports always strive to reach a zero position. For this purpose, mechanical spring suspensions of any kind can be used. Likewise, however, hydraulic or pneumatic spring devices are also possible, accordingly. In the case of a switch in the flat material, in particular, it can thereby be ensured in relatively simple manner that new flat material can run into the system without problems.

It is understood that the characteristics of the solutions described above and in the claims can also be combined, if applicable, in order to be able to implement the advantages cumulatively, accordingly.

Figure 2:
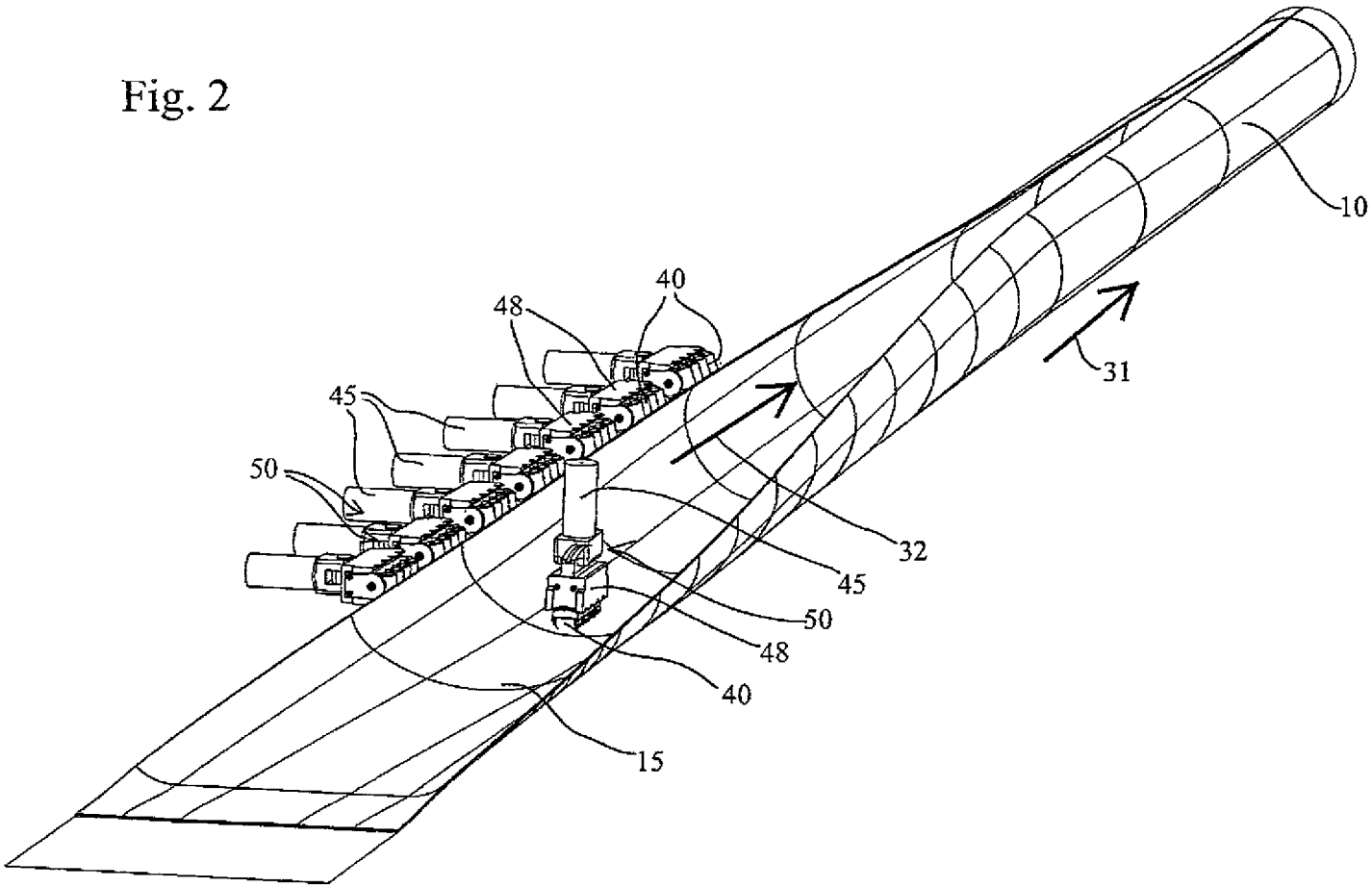
Figure 3:
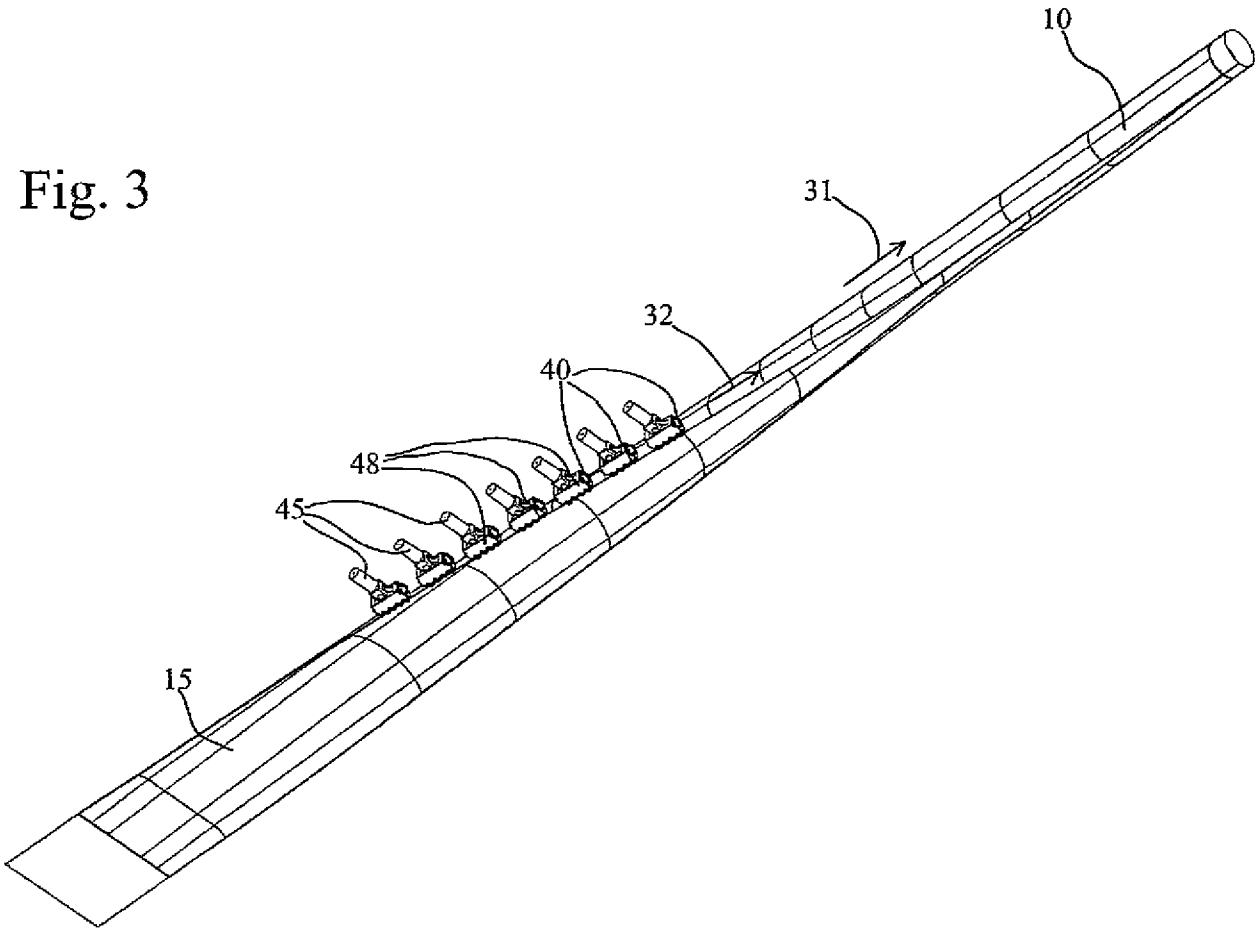
Figure 4:
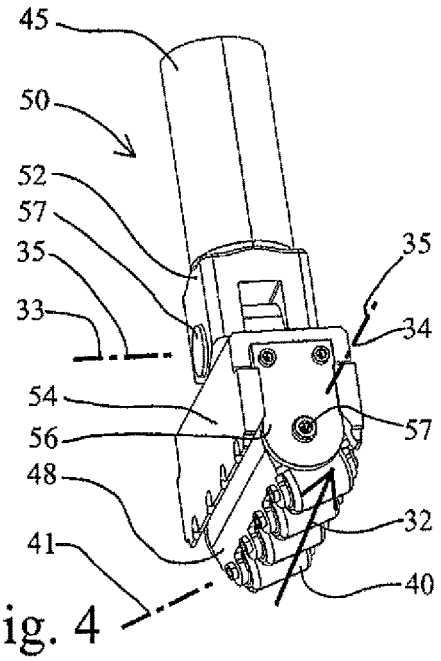
Figure 5:
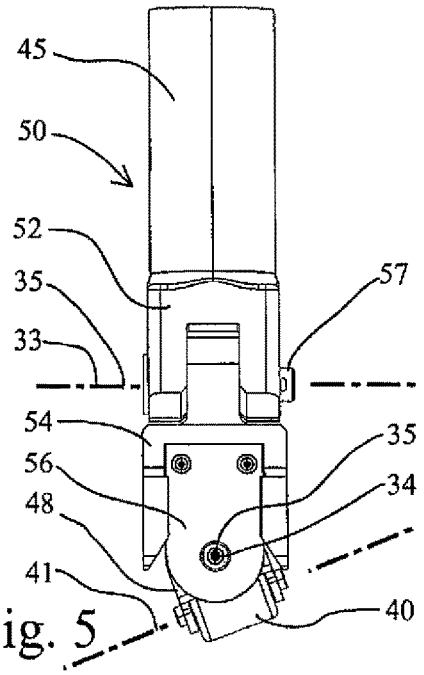
Figure 6:
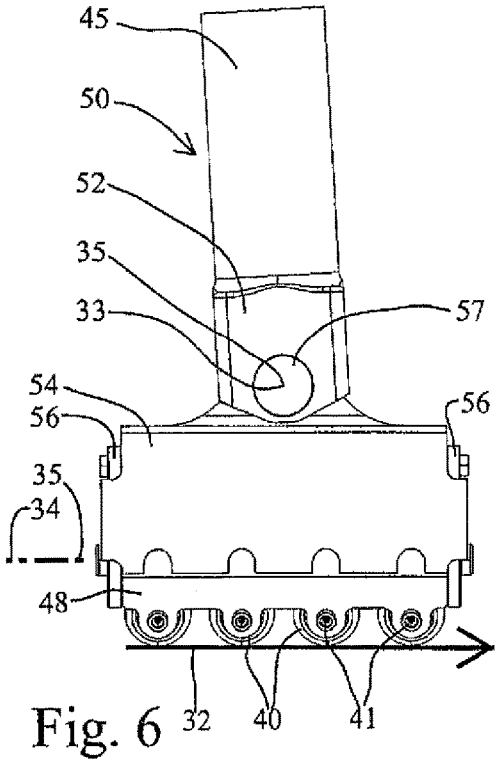
Figure 7:
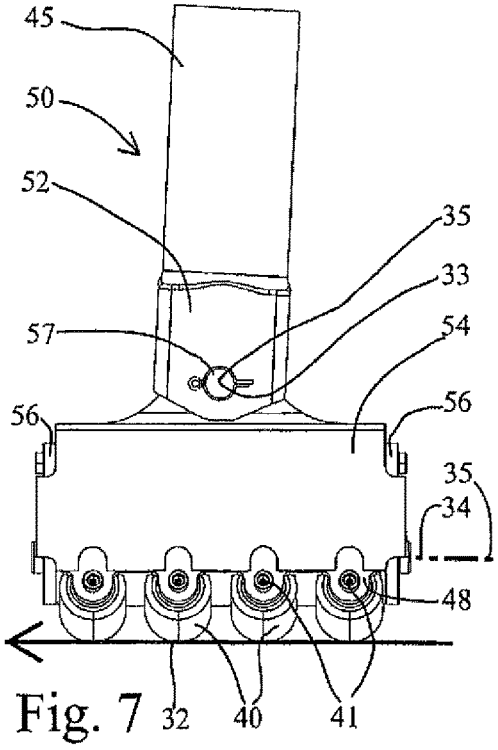
Figure 12:
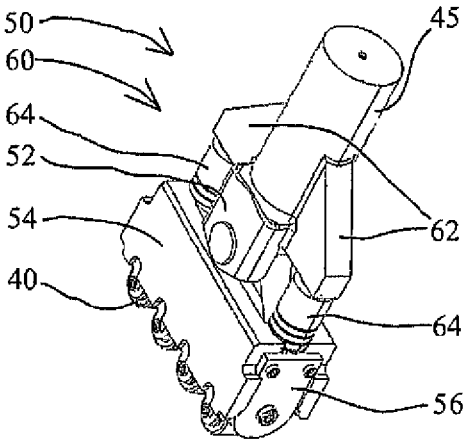
Figure 13:
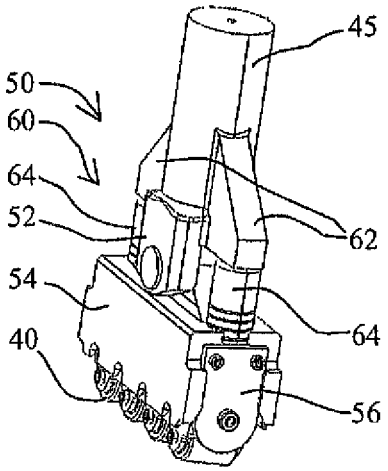
Figure 14:
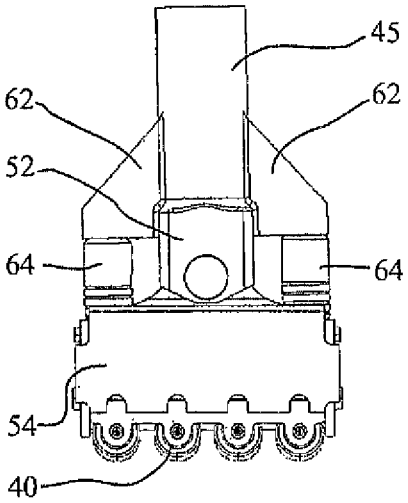
Figure 15:
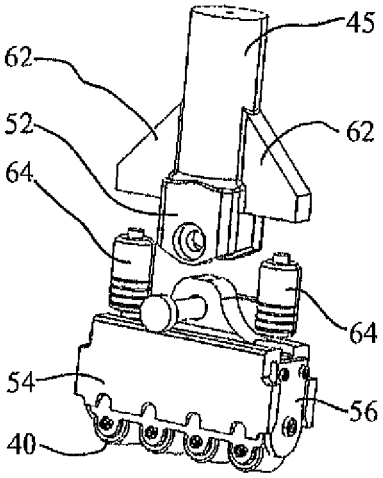

Further advantages, goals, and properties of the present invention will be explained using the following description of exemplary embodiments, which are particularly shown also in the attached drawing. The drawing shows:

FIG. 1 a perspective schematic view of a first system for continuous molding of longitudinally slotted pipes;

FIG. 2 a perspective schematic view of a second system for continuous molding of longitudinally slotted pipes;

FIG. 3 a perspective schematic view of a third system for continuous molding of longitudinally slotted pipes;

FIG. 4 a perspective view of a first roll support that can be used in the aforementioned systems;

FIG. 5 the roll support according to FIG. 4 in a front view;

FIG. 6 the roll support according to FIGS. 4 and 5 in a side view;

FIG. 7 the roll support according to FIGS. 4 to 6 in a further side view;

FIG. 8 a further roll support that can be used in one of the aforementioned systems, in a front view;

FIG. 9 the roll support according to FIG. 8 in a perspective representation, similar to FIG. 4;

FIG. 10 the roll support according to FIGS. 8 and 9 in a first exploded representation;

FIG. 11 the roll support according to FIGS. 8 to 10 in a further exploded representation;

FIG. 12 a perspective view of a further roll support that can be used in one of the aforementioned systems;

FIG. 13 the roll support according to FIG. 12 in a further perspective view;

FIG. 14 the roll support according to FIGS. 12 and 13 in a side view; and FIG. 15 the roll support according to FIGS. 12 to 14 in an exploded representation.

In the systems for continuous molding of longitudinally slotted pipes 10 from a flat material 15 shown in FIGS. 1 to 3, multiple roll stands 45 (here only numbered as examples and represented schematically by a fixed cylinder that is not numbered separately) are disposed one behind the other in a system direction 31, so that each cross-section of the flat material 15 successively moves past each of the roll stands 45. The roll stands 45 carry rolls 40 on roll supports 48, in each instance, whereby for reasons of clarity, only a part of the rolls that are necessary for molding, in each instance, is shown in FIGS. 1 to 3. In particular, in FIGS. 1 to 3, for reasons of clarity, no representation of the rolls 40, roll supports 48, and roll stands 45 is provided on the right system side, for the sake of a clearer illustration, because ultimately, these are generally configured in a mirror image to the rolls 40, roll supports 48, and roll stands 45 on the left system side. It is understood that the placement of the rolls 40 is, in any case, adapted to the material requirements and desired bending radii, in each instance, in suitable manner, in every concrete embodiment.

As is directly evident, the system shown in FIG. 1 has two roll supports 48 disposed next to one another, having rolls 40, which act on the side of the flat material 15 that represents the inside of the pipe 10 after the process. In contrast, the system according to FIG. 2 merely has one such arrangement, while the system according to FIG. 3 does without any such arrangement.

In this connection, it is understood that suitable systems or arrangements can be selected in accordance with the material properties of the flat material 15 as well as the dimensioning of the pipe 10, whereby in particular, the arrangements according to FIGS. 1 to 3 can also be combined.

It is furthermore understood that the pipe 10 can subsequently be passed on to further processing, particularly, for example, welding of the slot that has still remained open.

The system direction 31 ultimately represents approximately an average value of the pass-through direction of the flat material 15 through the system, whereby ultimately, a cross-section of the flat material successively moves past the roll stands 45 and the rolls 40, as a result of the process. However, the individual material points of such a cross-section have different material running directions 32, in accordance with the bending process, whereby it can be assumed that aside from process-related variations, every material point of the flat material 15 that is identically disposed at the same system height, in terms of cross-section, will also have the same material running direction 32. Wherever the rolls 40 come into contact with the flat material 15, in each instance, a material running direction 32 of the roll 40, in each instance, or at the roll 40, in each instance, follows directly. A corresponding material running direction is also indicated schematically in FIGS. 4, 6, 7, and 10.

In detail, the roll arrangements according to FIGS. 4 to 11 comprise four rolls 40, in each instance, which are mounted on a common roll support 48. In this manner, the rolling forces that act on the roll support 48 are distributed to the four rolls 40 provided thereon, and are therefore introduced into the flat material 15 over a relatively large area.

Both arrangements shown in FIGS. 4 to 11 can be used in the systems of FIGS. 1 to 3, whereby preferably, the arrangement of FIGS. 4 to 7 appears particularly suitable for lateral roll arrangements that act on the flat material 15 from the side of the flat material 15 that later represents the outside of the pipe 10, because these arrangements already run in relatively stable manner in themselves, and the likelihood of lateral break-out at any joints is relatively low. This is different in the case of roll arrangements that act on the side of the flat material 15 that later represents the inside of the pipe 10. These rolls frequently run in unstable equilibrium and tend to break out laterally, particularly if the rolling forces become too great or process-immanent variations occur. The arrangement according to FIGS. 8 to 11 is better suited for such cases. In this connection, it is understood that depending on the concrete requirements, the arrangements of FIGS. 8 to 11 and 4 to 7 can also be used differently. In particular, it is understood that in deviating embodiments, these arrangements can also be combined with other roll arrangements, and that the systems 1 to 3 can also be provided with other roll arrangements, particularly, of course, with further roll arrangements that implement the characteristics of the present claims.

In this connection, in the arrangements according to FIGS. 4 to 11, the rolls 40 are connected with the roll stand 45 by way of a fork 52 of the positioning means 50, in each instance, which stand in turn has a cylinder (not numbered), into which the fork 52 is inserted with a piston (not shown). In this manner, the fork 52 of each individual roll support 48 can be positioned parallel to the alignment of the cylinder or the piston in the direction of the system center, and this brings about very precise positioning of the roll support 48 and therefore of the rolls 40. In this connection, it is also possible, particularly in a special embodiment, to couple these cylinders with one another, all of them or in groups, in each instance, with pressure equalization, so that the press-down pressure that bears down on all the roll supports is the same. However, the latter does not necessarily have to be implemented in this way. Instead, it is also possible to provide all or at least two forks 52 that are disposed on one system side, in other words at least two forks 52 on the right system side or at least two forks 52 on the left system side or two forks 52 in the center of the system, directly on a common support, which in turn can be positioned by way of suitable positioning means, such as, for example, by way of piston/cylinder units, whereby this can take place, on the one hand, along a predetermined path, or also, for example, by means of two or more piston/cylinder units, also with regard to changeable positioning angles, both perpendicular and parallel to the system direction 31, or by means of changing the incline about an axis parallel to the system direction 31.

The fork 52 carries an intermediate support 54, in each instance, whereby this is implemented by a rotary hinge bolt 57 in the exemplary embodiment according to FIGS. 4 to 7, while this happens by means of rotary guide surfaces 58 in the arrangement according to FIGS. 8 to 11, which surfaces are configured on the fork 52, on the one hand, and on the intermediate support 54, on the other hand, and by way of a securing motion link 59 (see FIG. 8), which runs in a securing groove, not numbered separately, so that the intermediate support 54 is secured on the fork 52.

As is directly comprehensible, the rotary hinge bolt 57 brings about an axis of rotation 35 of the intermediate support 54, including the modules carried by it, which axis is aligned coaxial to the rotary hinge bolt 57. Depending on the curvature of the two rotary guide surfaces 58 on the fork 52 and the intermediate support 54 of the exemplary embodiment shown in FIGS. 8 to 11, the axis of rotation 35 of this arrangement can, in contrast, ultimately be displaced within relatively broad limits. As a result, in the embodiment shown in FIGS. 8 to 11, there is a degree of rotational freedom 33 that is represented on the other side of the flat material 15, as is directly comprehensible from FIGS. 8 and 9, so that in this manner, a stable equilibrium of the corresponding rotary joint is guaranteed. As is particularly evident in FIG. 9, the degree of rotational freedom 33 lies parallel to at least one roll axis 41 of the rolls 40 that are carried by the roll support 48, or perpendicular to the material running direction 32 of the rolls 40 that belong to this material running direction 32.

The degree of rotational freedom 33 of the rotary joint situated between the fork 52 and intermediate support 54 of the exemplary embodiment according to FIGS. 4 to 7 also lies parallel to at least one roll axis 41 of the roll 40 carried by the roll support 48, if the roll support 48 is aligned accordingly. In this connection, it should be clarified, in general, that the aforementioned parallelity can be implemented, in complementary manner, in that the degree of rotational freedom 33 should be aligned perpendicular to the material running direction 32 of at least one roll carried by the roll support 48.

The roll support 48 is mounted on the intermediate support 54 by way of rotary guide surfaces 58 (not explicitly shown in the exemplary embodiment according to FIGS. 4 to 7), in each instance, whereby it is secured by way of side plates 56 on the face side.

In this connection, a rotary bolt, not numbered, is disposed in the side plates 56 of the exemplary embodiment shown in FIGS. 4 to 7, in each instance, which bolt secures the roll support 48 in the intermediate support 54 and defines an axis of rotation 35 with a degree of rotational freedom 34, which axis is aligned parallel to the material running direction 32 at the rolls 40. In this connection, the rolling forces of the rolls 40 that act successively on the flat material 15 are transferred by way of the rotary guide surfaces between roll support 48 and intermediate support 54, and only a small part of these forces is absorbed by the rotary bolt. As is directly evident, the axis of rotation 35 of the degree of rotational freedom 34 also lies on this side of the flat material 15 from the perspective of the rolls 40. It is true that this might lead to a slightly more unstable equilibrium when rolling forces act on this arrangement. However, this can be tolerated, if applicable, depending on the dimensioning of the rolling forces and the rolls.

In the exemplary embodiment according to FIGS. 8 to 11, as well, the roll support 48 is mounted on the intermediate support 54 by way of rotary guide surfaces 58, whereby in this exemplary embodiment, the side plates 56 have securing motion links 59 that run in corresponding securing grooves, not separately numbered, and secure the roll support 48 in its position on the rotary guide surface 58 of the intermediate support 54. In this connection, the rotary guide surfaces 58 and the securing guide track of the securing motion link 59 can be freely selected within broad limits, so that in this exemplary embodiment, the axis of rotation 35 of the degree of rotational freedom 34 can be found on the other side of the flat material 15, from the perspective of the rolls 40. It is understood that under certain circumstances, the axes of rotation 35 of the exemplary embodiment shown in FIGS. 8 to 11 can also be provided within the flat material 15 or actually on this side of the flat material 15, if this is possible under process conditions or actually appears necessary. The selected embodiment of the rotary guide surfaces 58, in contrast, allows an extremely stable equilibrium, in each instance, when the arrangement according to FIGS. 8 to 11 is subjected to a load.

As is directly evident, the axis of rotation 35 of the degree of rotational freedom 34 is aligned parallel to the material running direction 32 in the case of this exemplary embodiment, as well.

It is understood that the intermediate support 54 and/or the roll support 48 can easily be biased by means of suitable spring arrangements, which bring about, for example, a return pull into a neutral position, in each instance, in such a manner that they tend to spring back into a correspondingly determined neutral position, in each instance. Such springs can be mechanical springs, for example, which act parallel to the guide direction. Likewise, pressure springs or also hydraulic or pneumatic arrangements, for example at the front and the back, can act on the intermediate support, in order to bring about a corresponding positioning behavior.

The arrangement shown in FIGS. 12 to 15 essentially corresponds to the arrangement according to FIGS. 4 to 7 and can also be used in the systems of FIGS. 1 to 3. To avoid repetition, there will be no explanation of identical modules at this point, and reference is made to the explanations concerning the arrangement according to FIGS. 4 to 7 in this regard.

In deviation from the arrangement according to FIGS. 4 to 7, the arrangement according to FIGS. 12 to 15 supplementally has two projections 62 on the roll stand 45, on which projections springs 64 engage, which springs in turn act on the intermediate support 54. As is directly comprehensible from the figures, the projections 62 are provided in accordance with the alignment of the intermediate support 54 on both sides of the fork 52, so that the latter allows the roll support 48 to strive toward a zero position with regard to the degree of rotational freedom 33 (not shown in FIGS. 12 to 15, but corresponds to the representations in FIGS. 4 to 7 in this regard), about the related axis of rotation 35 (not shown in FIGS. 12 to 15, but corresponds to the representations in FIGS. 4 to 7 in this regard), so that the roll support 48 assumes a defined position with regard to the degree of rotational freedom 33 even in the unstressed state.

Such spring means 60 can, however, also be implemented differently, for example by means of flat helical springs, by means of pneumatic springs or by means of other devices that have a resetting effect, and can also be provided with regard to the degree of rotational freedom 34. It is also understood that corresponding spring means 60 can also be provided in the arrangement according to FIGS. 8 to 11.

REFERENCE SYMBOL LIST

10 pipe
15 flat material
31 system direction
32 material running direction
33 degree of rotational freedom
34 degree of rotational freedom
35 axis of rotation
40 roll
41 roll axis
45 roll stand
48 roll support
50 roll positioning means
52 fork
54 intermediate support
56 side plate
57 rotary hinge bolt
58 rotary guide surface
59 securing motion link
60 spring means
62 projection
64 spring

The invention claimed is:

1. A system for continuous molding of longitudinally slotted pipes from a flat material comprising roll stands disposed one behind the other in a system direction, wherein each roll stand carries at least a respective first roll having a respective first roll axis, wherein at least one of the roll stands is a roll support roll stand having a roll support that carries at least the first roll, and second, third and fourth rolls disposed one behind the other in the system direction, wherein the roll support is mounted freely on the roll support roll stand by way of a roll positioning device having a degree of rotational freedom parallel to the first roll axis of the first roll carried by the roll support, a degree of rotational freedom perpendicular to a material running direction of the flat material on the first roll carried by the roll support and wherein there are two projections located on opposite sides of the degree of rotational freedom parallel to the first roll axis (62) on each roll stand (45) on which projections springs (64) engage, which springs in turn act on an intermediate support connected to the roll support (54).

2. The system according to claim 1, wherein the roll positioning device has at least one of a degree of rotational freedom perpendicular to the first roll axis of the first roll carried by the roll support and a degree of rotational freedom parallel to the material running direction.

3. The system according to claim 1, wherein the roll positioning device has at least one positioning position for positioning the first, second, third and fourth rolls and an axis of rotation on an other side of the flat material from the perspective of a corresponding roll of the rolls in the at least one positioning position.

4. The system according to claim 1, wherein the roll support carries not more than ten rolls disposed one behind the other in the system direction.

5. The system according to claim 1, wherein the respective first roll has a diameter and a width, wherein the width is greater than half the diameter.

6. The system according to claim 1, wherein the rolls are longer than their diameter.

7. The system according to claim 1, wherein every roll axis of every roll of one roll stand of the roll stands is in a stationary position with respect to every other roll axis of the rolls of said roll stand.

8. A system for continuous molding of longitudinally slotted pipes from a flat material, the system comprising roll stands disposed one behind the other in a system direction, wherein each roll stand carries at least a respective first roll having a respective first roll axis, wherein each first roll is freely mounted on the respective roll stand that carries the first roll, by way of a respective roll positioning device having an axis of rotation with at least one of a degree of rotational freedom perpendicular to the first roll axis and a degree of rotational freedom parallel to a material running direction of the flat material on the first roll, wherein said roll positioning device has a first part and a second part, wherein the first part is a roll stand side part, wherein the second part is a roll side part, wherein the second part rotates around said axis of rotation freely relatively to the first part, wherein each roll positioning device respectively has at least one positioning position for positioning the first roll and wherein there are rotary guide surfaces (58) having curved surfaces connecting the first part and the second part;

wherein the rotary guide surfaces (58) cause the roll positioning device to have said axis of rotation on an other side of the flat material from the perspective of a corresponding roll in the at least one positioning position.

9. The system according to claim 8, wherein the second part of the roll positioning device is a roll support, and wherein the first part of the roll positioning device is an intermediate support.

10. The system according to claim 8, wherein the second part of the roll positioning device is an intermediate support, and wherein the first part of the roll positioning device is the roll stand.

11. A method for continuous molding of longitudinally slotted pipes from a flat material comprising:

(a) successively moving the flat material past a plurality of roll arrangements comprising a plurality of roll stands; wherein each roll stand carries at least a respective first roll having a respective first roll axis, wherein at least one of the roll stands is a roll support roll stand having a roll support that carries at least the first roll, and second, third and fourth rolls disposed one behind the other in the system direction, wherein the roll support is mounted freely on the roll support roll stand by way of a roll positioning device having a degree of rotational freedom parallel to the first roll axis of the first roll carried by the roll support, a degree of rotational freedom perpendicular to a material running direction of the flat material on the first roll carried by the roll support and wherein there are two projections (62) located on opposite sides of the degree of rotational freedom parallel to the first roll axis on each roll stand (45) on which projections springs (64) engage, which springs in turn act on an intermediate support (54) connected to the roll support (b) successively applying to the flat material rolling forces of the at least four rolls on each one roll stand of the plurality of roll arrangements to bend the flat material; and wherein at least one of the following steps is performed:

(1) evenly absorbing the rolling forces into each roll stand; and (2) allowing the four rolls to position themselves, relative to one another.

12. The method according to claim 11, wherein 1) the rolling forces of not more than ten rolls successively acting on the flat material are evenly absorbed into the roll stand or wherein not more than ten successively acting rolls position themselves relative to one another or 2) wherein the rolling forces of not more than ten rolls successively acting on the flat material are evenly absorbed into the roll stand and not more than ten successively acting rolls position themselves relative to one another.

13. The method according to claim 11, wherein the rolls are longer than their diameter.

14. The method according to claim 11, wherein every roll axis of every roll of one roll stand of the roll stands is in a stationary position with respect to every other roll axis of the rolls of said roll stand.

15. A method for continuous molding of longitudinally slotted pipes from a flat material comprising:

(a) successively moving the flat material past a plurality of roll arrangements to bend the flat material; and (b) allowing two successively acting rolls to position themselves relative to one another; and (c) positioning the two successively acting rolls jointly, with a roll positioning device having at least one positioning position for positioning the two successively acting rolls and an axis of rotation represented on an other side of the flat material from the perspective of the two successively acting rolls, wherein said roll positioning device has a first part and a second part, and rotary guide surfaces (58) having curved surfaces connecting the first part and the second part;

wherein the first part is a roll stand side part, wherein the second part is a roll side part, and wherein the second part rotates around said axis of rotation freely relatively to the first part.

16. The method according to claim 15, wherein the second part of the roll positioning device is a roll support, and wherein the first part of the roll positioning device is an intermediate support.

17. The method according to claim 15, wherein the second part of the roll positioning device is an intermediate support, and wherein the first part of the roll positioning device is the roll stand.

18. A method for continuous molding of longitudinally slotted pipes from a flat material comprising:

(a) successively moving the flat material past a plurality of roll arrangements comprising a plurality of rolls and a plurality of positioning devices, each roll having a respective roll axis;

(b) successively applying to the flat material rolling forces of the plurality of rolls to bend the flat material; and (c) causing, via a respective positioning device having at least one positioning position, respectively, for positioning at least one roll of a respective roll arrangement and having a respective axis of rotation, the at least one roll of the respective roll arrangement to move with the rolling forces perpendicular to the roll axis or parallel to a material running direction of the flat material on the at least one roll, wherein the at least one roll of the respective roll arrangement moves with the rolling forces perpendicular to the roll axis and parallel to the material running direction, in the respective at least one positioning position, wherein said roll positioning device has a first part and a second part, wherein there are rotary guide surfaces (58) having curved surfaces connecting the first part and the second part;

wherein the rotary guide surfaces (58) cause the axis of rotation of the positioning device to be represented on an other side of the flat material from the perspective of a corresponding roll, wherein the first part is a roll stand side part, wherein the second part is a roll side part, and wherein the second part rotates around said axis of rotation freely relatively to the first part.

19. The method according to claim 18, wherein the second part of the roll positioning device is a roll support, and wherein the first part of the roll positioning device is an intermediate support.

20. The method according to claim 18, wherein the second part of the roll positioning device is an intermediate support, and wherein the first part of the roll positioning device is the roll stand.

* * * * *